United States Patent [19]

Peyre

[11] Patent Number: 4,682,786

[45] Date of Patent: Jul. 28, 1987

[54] SAFETY SKI BINDING

[75] Inventor: Henri Peyre, Nevers, France

[73] Assignee: Ste Look, French Societe Anonyme, Nevers, France

[21] Appl. No.: 778,244

[22] Filed: Sep. 20, 1985

[30] Foreign Application Priority Data

Oct. 4, 1984 [FR] France ..... 84 15229
Jul. 24, 1985 [FR] France ..... 85 11302

[51] Int. Cl.[4] ..... A63C 9/00
[52] U.S. Cl. ..... 280/628
[58] Field of Search ..... 280/626, 628, 625, 631, 280/632

[56] References Cited

U.S. PATENT DOCUMENTS 4,358,132 11/1982 Beyl ..... 280/628

FOREIGN PATENT DOCUMENTS 0025747 3/1981 European Pat. Off. .
2395046 1/1979 France .
2413915 8/1979 France .
2418656 9/1979 France .
2424037 11/1979 France .
2439601 5/1980 France .

*Primary Examiner*—John J. Love
*Assistant Examiner*—Michael Mar
*Attorney, Agent, or Firm*—Oblon, Fisher, Spivak, McClelland & Maier

[57] ABSTRACT

A ski binding of the multidirectional-trip type for obtaining a reduction in elastic resistance to rotational displacement in the event of a thrust exerted by the ski boot and in the event of upward disengagement of the boot. The ski binding comprises a boot-retaining jaw unit pivotally mounted for vertical displacement on a body which is rotatably mounted on a vertical pivot. The rotary body is maintained in the normal position by a resilient mechanism comprising two flat faces formed on opposite sides of the pivot. A bearing surface formed on the rotary body and a piston housed within the body are applied respectively against the two flat faces by a single spring. The jaw unit is provided with guide ramps and maintained in the normal position by a cross-pin the ends of which are in contact with the ramps.

7 Claims, 11 Drawing Figures

SAFETY SKI BINDING

BACKGROUND OF THE INVENTION

1. Field of the Invention

The present invention relates to safety ski bindings which are adapted either to lock the toe end of a ski boot in position so as to constitute a toe abutment device or to lock the heel end of a ski boot so as to form a heel-holding device.

In more precise terms, the invention relates to the so-called multidirectional-trip ski bindings. This type of ski binding comprises a boot-retaining jaw unit mounted for pivotal displacement in the vertical direction on a body which is in turn rotatably mounted on a pivot located at right angles to the ski. A resilient mechanism is provided for maintaining the jaw unit and body in their normal positions.

Thus, in the event of torsional stress exerted on the skier's foot, the jaw unit is capable of lateral displacement by rotating with the ski-binding body about the pivot in order to permit lateral disengagement of the ski boot. However, this jaw unit is also capable of undergoing an upward pivotal displacement in order to permit disengagement of the ski boot in this direction also, either in the event of a forward fall in the case of a heel-holding device or in the event of a backward fall in the case of a toe-abutment device.

2. Description of the Prior Art

In order to achieve a satisfactory degree of safety, certain types of toe bindings or abutment devices are so designed that a forward thrust exerted on the ski boot and caused by an incipient forward fall, for example, produces a reduction in the elastic resistance acting in opposition to rotational displacement of the corresponding toe-abutment device. In point of fact, this forward thrust increases the friction forces sep up by the ski boot and consequently increases the stiffness or ski-boot release. It is therefore necessary to reduce the elastic resistance of the boot-retaining mechanism in order to ensure that the magnitude of the retaining force remains substantially the same.

Thus, French Pat. No. 2,395,046 describes a toe-abutment device in which the boot-retaining jaw unit is mounted for axial sliding motion on the rotary body of the jaw unit in such a manner as to produce a reduction in torsional elastic resistance in the event that a thrust is exerted on said jaw unit in the forward direction. The resilient mechanism provided in this abutment device consists of a piston which is housed within the rotary body and is applied by a spring against a flat face formed on the pivot. Said piston is adapted to carry two lateral extensions placed on each side of the pivot. In the event of a forward displacement of the boot-retaining jaw unit, this unit exerts a thrust on the ends of the above-mentioned lateral extensions, thereby moving the piston away from the flat face (which normally serves as a bearing surface for the piston) and thus permitting free rotational displacement of the abutment body.

In the event of a forward fall, the ski boot is therefore completely released. However such an abrupt release constitutes a potential hazard. Furthermore, the toe-abutment device described in the cited patent document does not in any way permit release of the ski boot in the event of a backward fall. A fortiori, no arrangements are therefore made to reduce elastic resistance to rotational displacement in the event of a backward fall.

French Pat. No. 2,439,601 describes a ski binding which can constitute both a heel-holding device and a toe-abutment device. This ski binding is so designed as to permit upward release of the ski boot, which is not the case with the toe-abutment device mentioned earlier. The ski binding described in this second patent comprises an end-piece which is capable of upward pivotal displacement and is carried by a body, said body being in turn rotatably mounted on a pivot which is perpendicular to the ski. This pivot has two flat faces which are oriented in opposite directions and against which are applied respectively a bearing surface formed in the end-wall of the rotary body and a piston mounted within this latter, a single spring being applied against said piston. The corresponding jaw unit is pivotally mounted directly on the rotary body of the ski binding about a transverse axis parallel to the top surface of the ski. However, this jaw unit is maintained in its normal position by a cross-pin interposed between the end-wall of the rotary body and the corresponding flat face of the pivot, the opposite ends of said cross-pin being adapted to cooperate with guide ramps provided on said jaw unit.

When this ski binding is employed as a toe-abutment device, it permits both lateral disengagement of the ski boot under the action of a very high torsional stress as well as upward disengagement of the toe end of the boot under the action of a backward fall. However, this ski binding is so designed that the jaw unit remains engaged with the corresponding end of the ski boot over a substantial range of travel.

To this end, the rotary body is capable of sliding in the rearward direction with respect to said pivot, and the boot-retaining jaw unit is in turn capable of sliding in the axial direction on said body, the axis of pivotal displacement of the jaw unit being materialized by trunnions carried by said body and engaged within slots formed in said jaw unit. Thus a rotational displacement of the body of the ski binding produces a rearward displacement of the binding and of the jaw unit.

In the event of upward displacement of the jaw unit, the procedure is the same. However, this movement is also accompanied by a movement of the bearing surface away from the rotary body with respect to the corresponding flat face of the pivot, which accordingly produces a reduction in the elastic resistance to rotational displacement of the ski-binding body.

However, when the ski binding is employed as a toe-abutment device, the above-mentioned reduction in elastic resistance to rotation takes place only in the event of a backward fall, whereas a forward fall produces no such reduction. In actual practice, however, a large number of falls experienced by skiers correspond to a complex movement of falling forward and twisting. When this occurs, it is essential to provide for a reduction in the resistance which acts in opposition to a rotational displacement. The ski binding disclosed in the cited patent fails to achieve this result.

SUMMARY OF THE INVENTION

The aim of the present invention is therefore to provide a ski binding of the multidirectional-trip type which is so designed as to obtain a reduction in elastic resistance to rotational displacement both at the time of a thrust exerted by the ski boot on said ski binding and in the event of an upward disengagement of the boot. Thus, when said ski binding is employed as a toe-abutment device, said binding is capable of releasing the boot in the event of a torsional stress, or in the event of a backward fall, or again in the event of a forward fall or of a complex movement. The ski binding in accordance with the invention comprises a boot-retaining jaw unit for securing either the toe end or the heel end of a ski boot, said jaw unit being mounted on a body for pivotal displacement in the vertical direction, said body being in turn rotatably mounted on a pivot which is perpendicular to the ski. This rotary body is maintained in its normal position by a resilient mechanism comprising two flat faces which are formed on the pivot in opposite directions. A bearing surface formed on the rotary body and a piston housed within said body are applied respectively against the two flat faces aforesaid by a single spring. The boot-retaining jaw unit is maintained in its normal position by a cross-pin whose ends are in contact with guide ramps carried by said jaw unit.

The ski binding in accordance with the invention is distinguished by the following features:

- the flat face against which the rotary body is applied is smaller in width than the flat face against which the piston is applied and which is oriented in the direction opposite to the ski-boot location;
- the pivot-pin of the boot-retaining jaw unit is carried by the piston;
- the cross-pin associated with said jaw unit is interposed between said piston and the pivot of the rotary body;
- and the guide ramps provided on the boot-retaining jaw unit for cooperating with the cross-pin are capable of producing a forward movement of said jaw unit in the event of upward pivotal displacement of said unit by virtue of the fact that said cross-pin bears on the pivot.

Thus, when said ski binding is employed as a toe-abutment device, a forward fall produces a forward displacement of the boot-retaining jaw unit. This has the effect of moving the internal piston away from the corresponding flat face of the pivot and consequently of producing a reduction in elastic resistance to rotational displacement by reason of the fact that the elastic pressure of the mechanism is exerted at this stage only on the flat pivot face which has the smaller width. In the event of a backward fall, the upward pivotal displacement of the jaw unit also produces a movement of the internal piston away from the corresponding flat face, this movement being carried out under the action of the guide ramps provided on the jaw unit, said ramps being adapted to cooperate with the cross-pin which is applied on the pivot.

BRIEF DESCRIPTION OF THE DRAWINGS

Other features of the invention will be more apparent to those versed in the art upon consideration of the following description and accompanying drawings, wherein.

DESCRIPTION OF THE PREFERRED EMBODIMENTS

Figure 1:
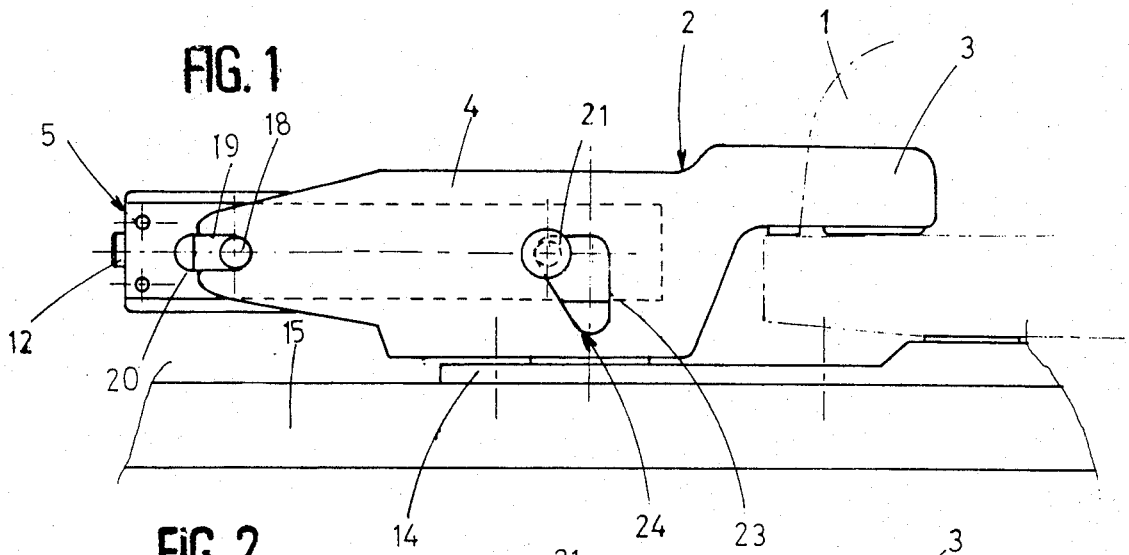
FIG. 1 is a view in elevation of the corresponding ski binding as shown in its normal position.

As has already been mentioned in the foregoing, the ski binding shown in the accompanying drawings is employed as a toe-abutment device for securing the front or toe end of a ski boot 1. It will be apparent, however, that the ski binding could also be employed at the rear or heel end as a heel-holding device by suitably modifying its boot-retaining jaw unit and by adding a hand-operated boot-disengagement device.

The ski binding in accordance with the invention comprises a boot-retaining jaw unit 2, the rear end of which is adapted to carry two arms 3. The arms 3 are intended to be placed on each side of the toe end of the ski boot 1 to be locked in position. The front end of the jaw unit 2 assumes the shape of a yoke having two side cheeks 4 placed on each side of a rotary body 5 designed in the form of a box-frame.

The rotary body 5 of the jaw unit 2 is constituted by a U-shaped member which is mounted on edge and comprises two side walls 6 and a cross-piece 7 which forms the end-wall of the rotary body 5. The opposite end of the rotary body 5 is fitted with a spacer member 8.

Within the rotary body 5 is housed a hollow piston 9 containing a thrust spring 10. The thrust spring 10 bears against a member for adjusting its initial tension. In the example shown in the drawings, the member consists of a nut 11 threaded on an adjusting screw 12. The head of the adjusting screw 12 is rotatably mounted within the spacer member 8 and is accessible from the exterior. Rotational displacement of the nut 11 is prevented by providing the nut 11 with a polygonal contour which corresponds to the cross-section of a housing 25 provided inside the hollow piston 9.

The rotary body 5 is rotatably mounted on a pivot 13 carried by a base plate 14 which is fixed on the corresponding ski 15. The pivot 13 is perpendicular to the top surface of the ski 15.

Figure 2:
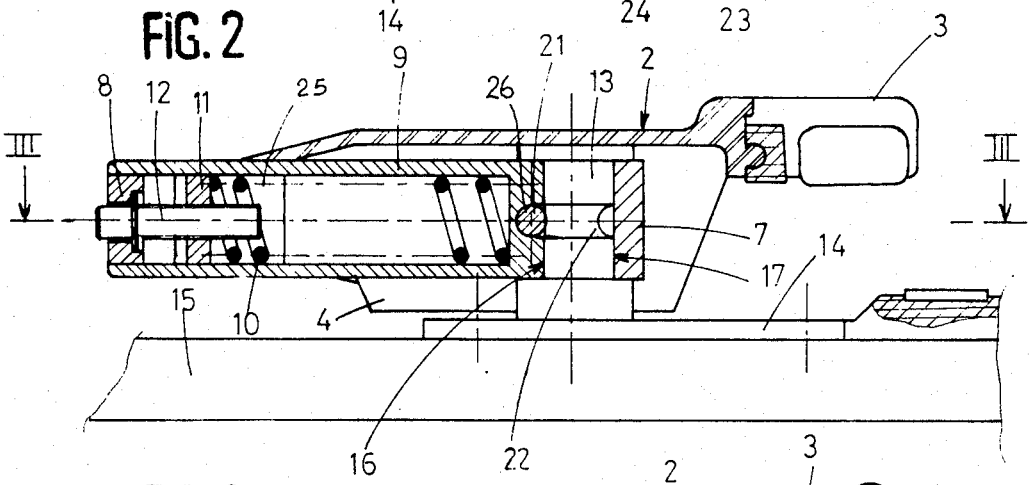
FIG. 2 is a vertical sectional view taken along a longitudinal axis.
Figure 3:
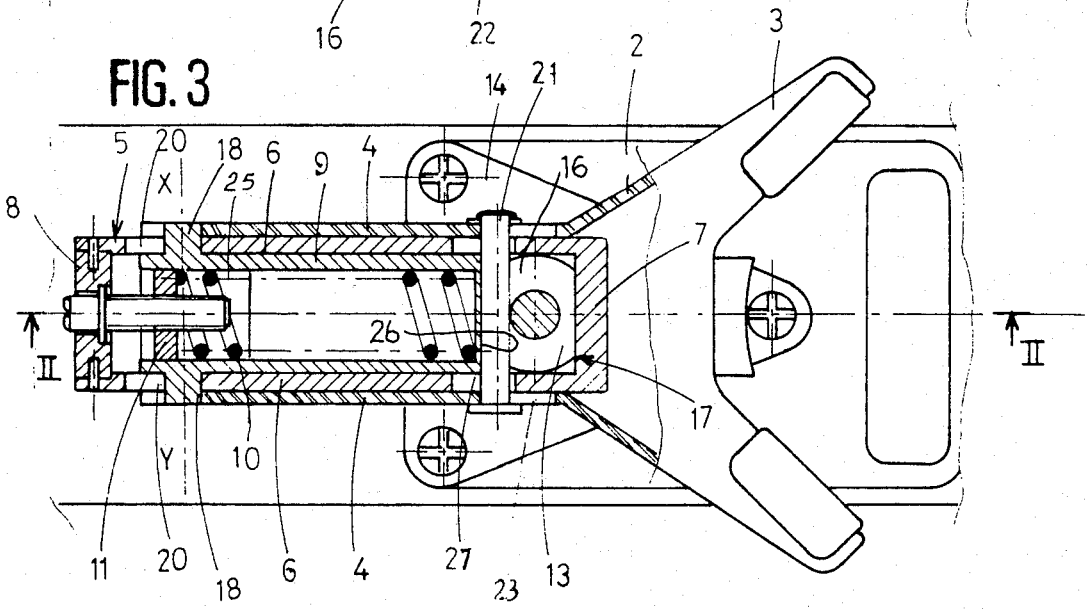
FIG. 3 is a sectional view taken along line III—III of FIG. 2.

As is clearly shown in FIGS. 2 and 3, the above-mentioned pivot 13 is located between the hollow piston 9 and the end-wall 7 of the rotary body 5. It is further apparent from FIG. 3 that the pivot 13 has two flat faces 16 and 17 which extend respectively along two transverse planes perpendicular to the ski. The flat face 16 is oriented towards the front end of the ski, and the flat face 17 is oriented towards the rear end. The thrust spring 10 has the double function of applying the hollow piston 9 against the first or forwardly directed flat face 16 and of applying the end-wall 7 of the rotary body 5 against the second or rearwardly directed flat face 17. Under these conditions, the rotary body 5 of the ski binding in accordance with the invention is normally maintained on the axis of the ski 15 as shown in FIG. 3.

However, in accordance with an important characteristic feature of the invention, the flat face 17 against which the rotary body 5 is applied has a smaller width than the flat face 16.

The boot-retaining jaw unit 2 is mounted so as to be capable of pivotal displacement about an axis X-Y, not on the rotary body 5, but on the hollow piston 9. The axis X-Y is parallel to the top surface of the ski 15 and extends transversely to the axis of the rotary body 5. The axis X-Y is materialized by two trunnions 18 provided on each side of the hollow piston 9 and engaged within slots 19 formed in the corresponding end portion of the side cheeks 4 of the jaw unit 2. However, the trunnions 18 are also engaged within elongated openings 20 which are formed in the corresponding sides of the rotary body 5 and within which the trunnions 18 are capable of sliding in the axial direction.

The boot-retaining jaw unit 2 is normally maintained in its lowered position shown in FIGS. 1 to 3 by means of a cross-pin 21 which is parallel to the top surface of the ski 15 and which is interposed between the hollow piston 9 and the pivot 13. At the level of the cross-pin 21, the pivot 13 has a groove 22 which completely surrounds the pivot 13 and within which the cross-pin 21 is partly engaged. Another groove 26 is formed in the corresponding face of the hollow piston 9 in order to provide the cross-pin 21 with a predetermined clearance space and to ensure that the flat face of the hollow piston 9 is perfectly applied against the flat face 16 of the pivot 13.

The extremities of the cross-pin 21 are slidably mounted within elongated slots 27 formed in the side walls 6 of the rotary body 5. However, the terminal portions of the extremities of the cross-pin 21 are engaged within different slots 23 formed in the side cheeks 4 of the jaw unit 2. As shown in FIG. 1, the slots 23 have the general shape of a right-angled triangle a base of which is located at the top and the hypotenuse 24 of which is inclined so as to constitute a guide ramp. The guide ramp is sized, shaped, and positioned to cooperate with the extremities of the cross-pin 21.

By virtue of this arrangement, the pressure of the thrust spring 10 which is exerted on the cross-pin 21 through the intermediary of the hollow piston 9 has the effect of maintaining the jaw unit 2 in its normal lowered position as shown in FIGS. 1 and 2.

Figure 4:
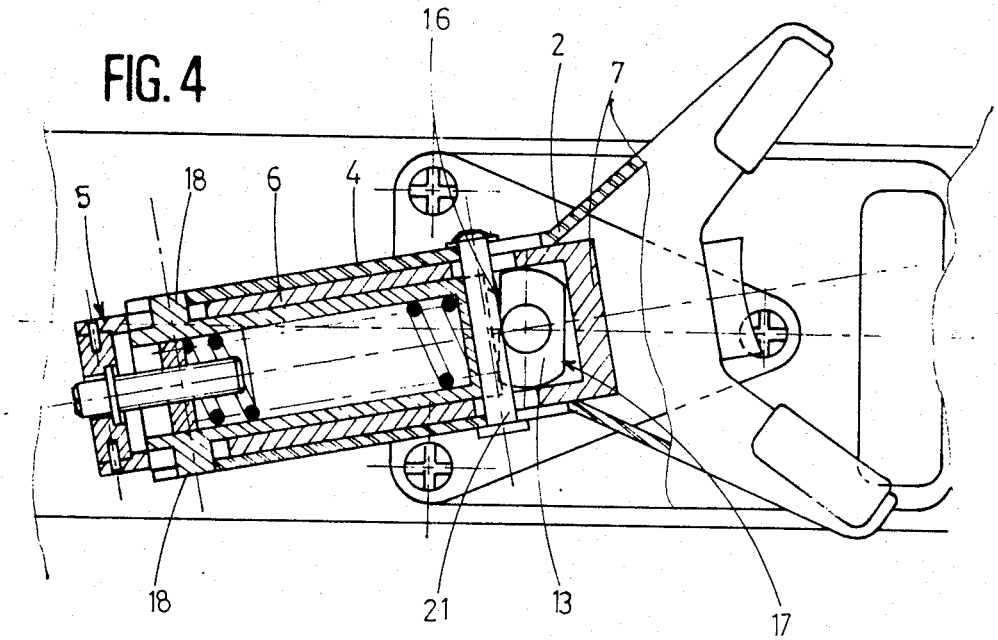
FIG. 4 is a sectional view which is similar to FIG. 3 but which shows the ski binding considered at the time of rotational displacement of its jaw unit and of its rotary body under the action of an excessive torsional stress.

The operation of the multidirectional-trip ski binding in accordance with the invention is as follows:

(1) - In the event of excessive torsional stress (FIG. 4):

In such a case, the jaw unit 2 is capable of displacement to one side by rotating with the rotary body 5 about the vertical axis of the pivot 13 and in opposition to the force exerted by the thrust spring 10. The hollow piston 9 and the bearing surface formed in the end-wall 7 of the rotary body 5 then take up an inclined position with respect to the two corresponding flat faces 16 and 17. This gives rise to a restoring torque which tends to return the entire ski-binding assembly to its normal position as soon as torsional stress is no longer exerted on the skier's foot.

It is worthy of note that, in such a case, the elastic resistance which acts in opposition to rotational displacement of the ski-binding assembly as a whole is set up both by the pressure exerted by the hollow piston 9 and by the pressure exerted by the end-wall 7 of the rotary body 5 against the two corresponding flat faces.

Figure 5:
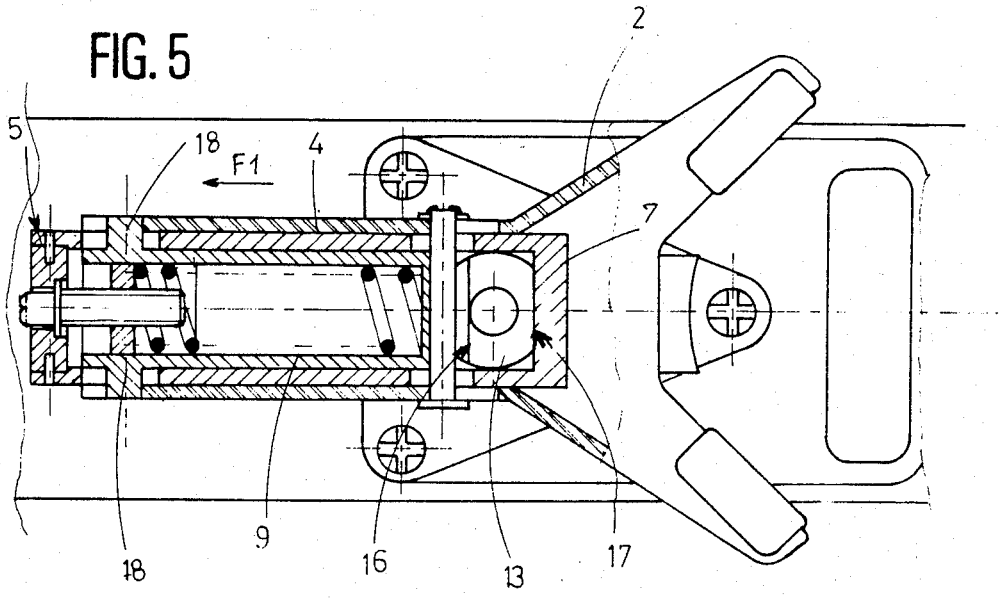
FIG. 5 is a sectional view which is similar to FIG. 3 but which shows the ski binding considered in the event of a forward thrust exerted by the ski boot, for example under the action of a forward fall.

(2) - In the event of a forward thrust (FIG. 5):

A forward thrust may be caused, for example, by a forward-fall movement of the skier or by flexural deformation of the ski, thereby producing a displacement of the jaw unit 2 in the direction of the arrow F1 by axial sliding motion on the rotary body 5. During its forward movement, the jaw unit 2 produces a forward displacement of the hollow piston 9 by exerting a thrust on the trunnions 18 which are carried by the hollow piston 9 and which are normally located in the bottom (i.e., the rear end) of the slots 19. In consequence, the hollow piston 9 is moved away from the corresponding flat face 16 formed on the pivot 13.

Under these conditions, only the rotary body 5 continues to exert pressure on the corresponding (rear) flat face 17 of the pivot 13. Since this flat face is smaller in width than the flat face 16, this results in a reduction of the elastic resistance to rotational displacement of the ski binding, despite the fact that the spring 10 has been subjected to a slight compression. In consequence, this effectively ensures the reduction in resistance to rotational displacement which is necessary in the event that the skier experiences a forward fall.

Figure 6:
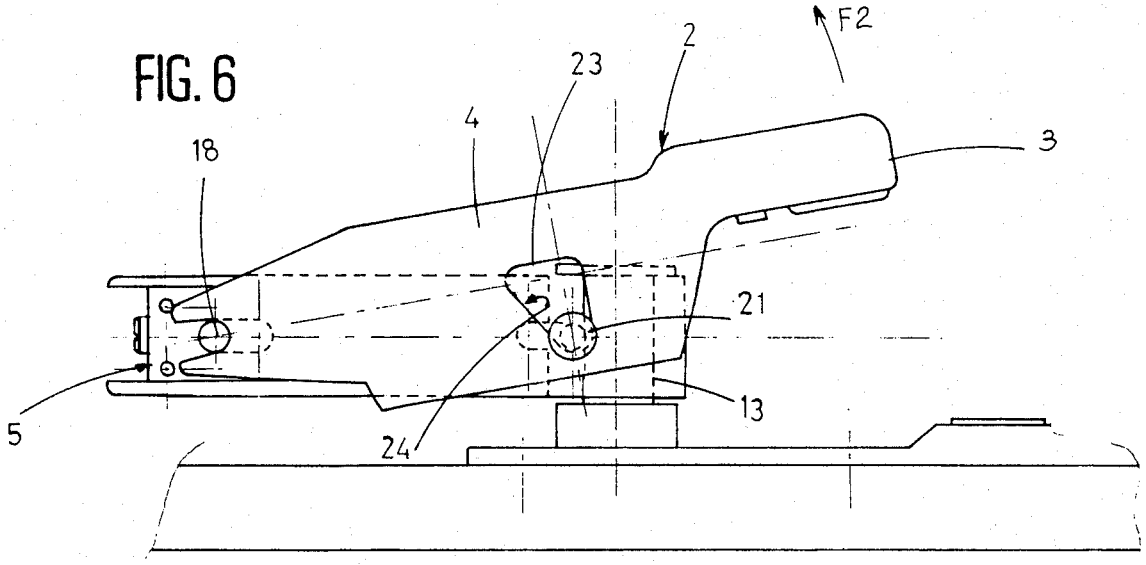
FIG. 6 is a view in side elevation showing the ski binding considered in the case of a backward fall.
Figure 7:
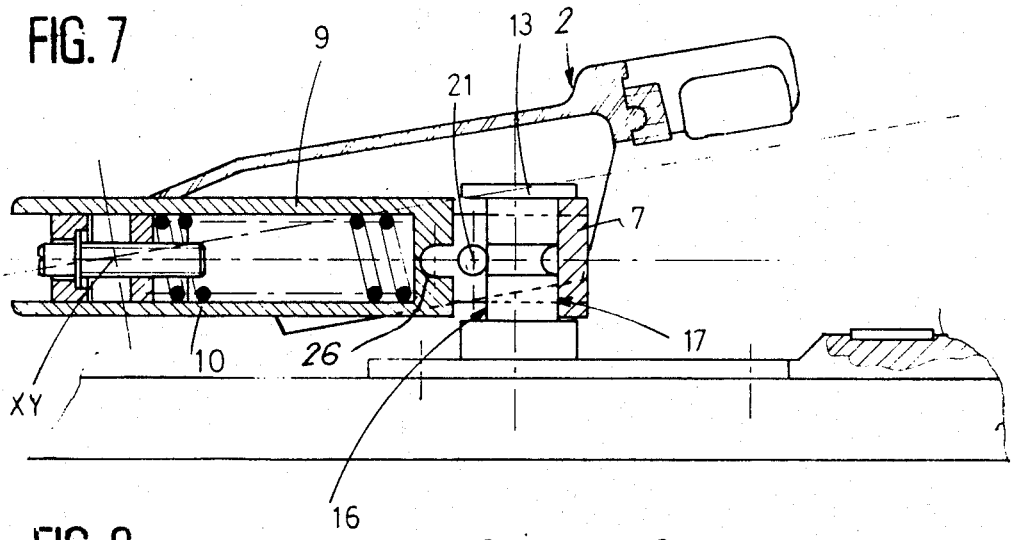
FIG. 7 is a longitudinal sectional view which is similar to FIG. 2 but which shows the ski binding considered in the event of a backward fall.

(3) - In the event of a backward fall (FIGS. 6 and 7):

In this instance, the front or toe end of the ski boot 1 tends to produce an upward pivotal displacement of the jaw unit 2 in the direction of the arrow F2 about the axis X-Y which is materialized by the trunnions 18. As this pivotal movement takes place, the ends of the cross-pin 21 are caused to slide against the inclined guide ramps 24 formed in the side cheeks 4 of the jaw unit 2. However, since the cross-pin 21 is located in a position in which it is applied against the bottom of the groove 22 in the pivot 13, a forward displacement of the jaw unit 2 is thus produced by reaction since the angle of slope of the guide ramps 24 is such that the lower end of the guide ramps 24 is located farther to the rear than the upper end.

As in the previous instance, the jaw unit 2 exerts a forward thrust on the hollow piston 9 during its movement of forward displacement.

This again has the effect of moving the hollow piston 9 away from the corresponding (forward) flat face 16 of the pivot 13 and consequently of reducing the elastic resistance to rotational displacement of the entire ski binding about the pivot 13.

In this case also, effective reduction of elastic resistance is therefore achieved and permits full compliance with required safety standards.

Furthermore, there also takes place a forward displacement of the jaw unit 2, which is helpful in disengaging the ski boot 1, all the more so as the axis X-Y of pivotal displacement of the jaw unit 2 is also advanced and results in compatibility of stiffness ratios between torsion and backward fall.

(4) - In the event of a complex movement:

It is wholly apparent that, in such a case, there is also obtained a reduction in resistance to rotational displacement for the reasons set forth in the two previous cases.

Under these conditions, the multidirectional trip ski binding in accordance with the invention achieves optimum safety. In contrast to many other types of ski bindings at present in existence, this result is in fact obtained by making use of very simple means with the minimum number of parts. This is therefore extremely advantageous in regard to the production cost of this ski binding and also from the standpoint of reliability.

As has already been mentioned, the ski binding under consideration can constitute not only a toe-abutment device as in the example described in the foregoing, but also a heel-holding device for retaining the heel of a ski boot.

In the example illustrated in FIGS. 8 to 11, consideration is given here to another alternative embodiment which has the general objective of simplifying the mechanical design of the ski binding while achieving enhanced ruggedness of construction and operational reliability as well as even lower costs. To this end, the boot-retaining jaw unit 2 is so designed as to have two side cheeks each terminating in a bearing surface of circular shape located in the forwardly directed portion of the cheek and centered on the pivotal axis of the jaw unit 2. This bearing surface is capable of rotating on a circular support which is also centered on the pivotal axis of the jaw unit 2 and formed on the corresponding side of the internal piston.

Figure 9:
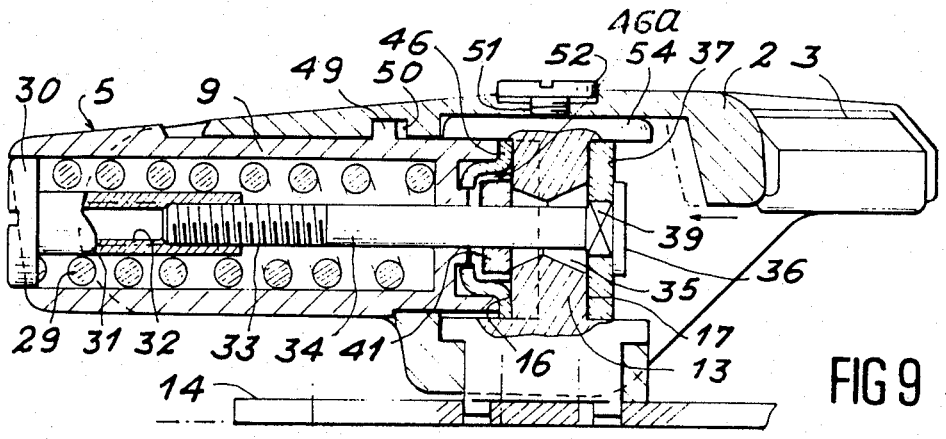
FIGS. 9 and 10 are axial sectional views taken respectively along a vertical plane and a horizontal plane, and showing the ski binding in accordance with FIG. 8.
Figure 10:
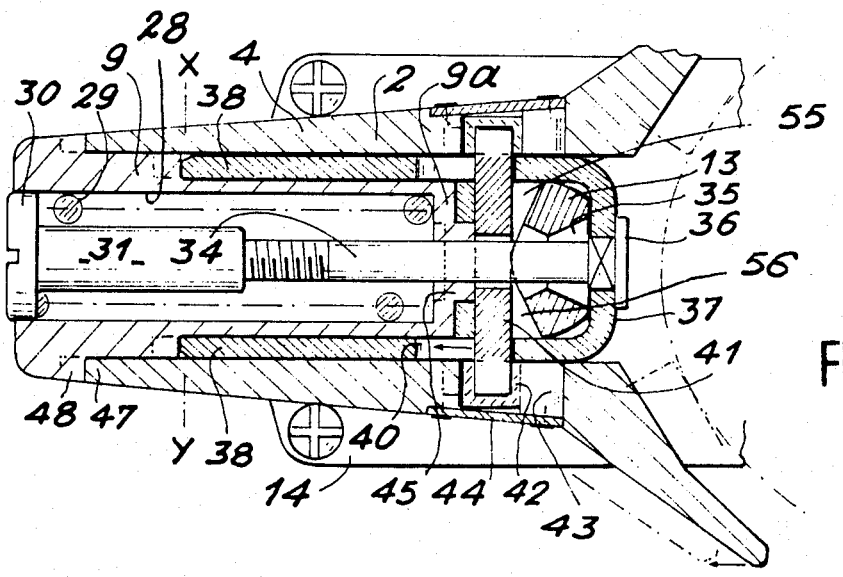

More specifically, and as shown in these figures, the front portion of the jaw unit 2 at the end remote from the arms 3 which surround the toe of the ski boot to be locked in position on the ski 15 assumes the shape of a yoke having two lateral cheeks which in turn surround the rotary body 5. The rotary body 5 is capable of rotating about the stationary pivot 13 carried by the base plate 14 which is fixed on the ski 15. The pivot 13 is provided with the two flat faces 16 and 17 respectively (as shown in FIG. 9) which extend in two transverse planes perpendicular to the ski 15. As before, the flat face 16 is oriented in the forward direction, and the flat face 17 is oriented in the rearward direction. The flat face 16 is so designed as to have a substantially larger area than the flat face 17 for reasons already explained in connection with the other embodiment. The pivot 13 has two recesses 55 and 56 which are opposite to a cross-member 41 whose function will be defined hereinafter and prevent the cross-member 41 from being thrust forward in the event of rotational displacement of the toe abutment unit under the cam action induced by the toe abutment unit.

In the example illustrated in FIGS. 8 to 11, the rotary body 5 directly constitutes the hollow piston 9 of the resilient ski-binding assembly. The hollow piston 9 is provided with an internal cylindrical bore 28 in which is housed a spring 29. One end of the spring 29 (namely, the end located nearest the front tip of the ski 15) is applied against a head 30 of a hollow nut 31 which is capable of engaging to a greater or lesser depth within the internal cylindrical bore 28 in order to compress the spring 29 against the end-wall **9*a* of the hollow piston 9. To this end, the hollow nut 31 is provided with an internally-threaded portion 32 which is adapted to cooperate with a threaded end 33 of a stud 34 extending through the vertical pivot 13 via a passage 35 formed axially in the pivot 13. The passage 35 is provided with a relieved portion which is intended to facilitate the machining operation, either in the form of an oblong groove or in the form of two opposite cone frustums joined together at their summits in order to permit free angular displacement of the rotary body 5 and of the stud 34 within the passage 35 of the stationary pivot 13** at the time of rotational displacements.

The stud 34 is also provided at the end remote from the hollow nut 31 with a bearing head 36 which is applied against an end-wall 37 of a stirrup-piece 38 for lateral guidance of the hollow piston 9. The stud 34 is secured against rotation with respect to the stirrup-piece 38 by means of a square boss 39 housed within a bore of corresponding shape formed in the end-wall 37.

Provision is made in the side arms of the stirrup-piece 38 for a longitudinal groove 40 through which are engaged the ends of the cross-member 41, these ends being advantageously covered by sleeves 42 forming rollers. The sleeves 42 are capable in particular of moving within an arcuate slot 43 formed in each side cheek 4 of the jaw unit 2 in order to permit upward pivotal displacement of the jaw unit 2 in the event of a backward-fall movement of the skier as mentioned in the previous examples. As an advantageous feature, the arcuate slots 43 formed in the jaw unit 2 are normally obturated by small plates 44 fixed externally on the cheeks 4 of the jaw unit 2.

In the normal position of the ski binding, the hollow piston 9 fitted within the rotary body 5 is subjected to the action of the spring 29, which causes the hollow piston 9 to bear against an abutment member 46. The abutment member 46 in turn bears against the face 16 of the pivot 13. The abutment member 46 is intended to afford resistance to wear caused by friction in the event of rotational displacements. The hollow piston 9 is made of light metal or of plastic material, and the cross-member 41 is housed within the abutment member 46 with allowance for a slight clearance **46*a* shown in FIG. 9**.

In the alternative embodiment considered, that portion of each side cheek 4 of the jaw unit 2 which is directed towards the front has a circular profile 47. Each circular profile 47 is adapted to cooperate by means of a relative sliding movement with a bearing surface 48 which is also circular and has the same center. Each beairng surface 48 is formed in the oppositely-facing end wall of the rotary body 5. The common centers respectively of the circular profiles 47 and of the bearing surfaces 48 corresponding to each side cheek 4 thus delimit on each side of the jaw unit 2 the axis X-Y of pivotal displacement of the jaw unit 2 in the event of a backward-fall movement of the skier, as will be explained more specifically hereinafter.

Figure 8:
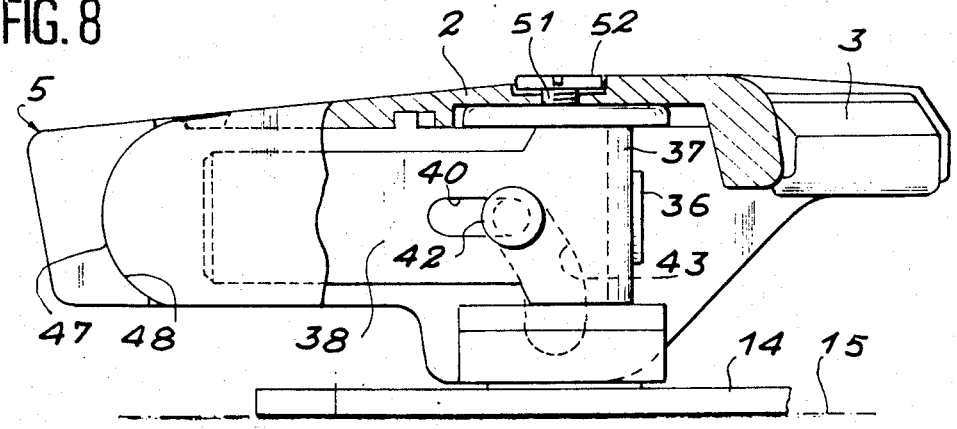
FIG. 8 is a schematic side view with a partial axial cross-section of another alternative embodiment of the ski binding in accordance with the invention.

In FIGS. 8 and 9, it can also be seen that the hollow piston 9 comprises a front lug 49 which penetrates into a groove 50 formed in the internal face opposite to the jaw unit 2. Finally, the jaw unit 2 is advantageously provided with an adjusting screw 51 having a head 52. The head 52 is mounted in a suitable milled recess formed in the jaw unit 2. In the normal position of the ski binding, the adjusting screw 51 is abuttingly applied against the top face 53 of the head 54 of the pivot 13. Depending on its relative position within its milled recess, the adjusting screw 51 thus serves to adjust the height of the boot-retaining jaw unit 2 and in particular the lateral arms 3 of the boot-retaining jaw unit 2 in order to ensure accurate adaptation of the arms 3 to the thickness of sole of the ski boot 1 which is engaged in the ski binding.

The operation of the alternative embodiment of the multidirectional-trip ski binding as hereinabove described with reference to FIGS. 8 to 11 is exactly the same as in the examples described earlier. Thus, especially in the event of a forward-fall movement of the skier, a force is applied on the jaw unit 2 in the forward direction. As a resrult of the cooperation of the circular profiles 47 formed in the cheeks 4 with the bearing surfaces 48 of the rotary body 5, the above-mentioned forwardly-directed force produces a forward displacement of the hollow piston 9 with relative compression of the spring 29, which is mounted between the end-wall 9*a* and the head 30 of the hollow nut 31. During this movement, the abutment member 46 thus withdraws from the forwardly directed flat face 16 formed on the stationary pivot 13, and the entire assembly consisting of the rotary body 5 and the boot-retaining jaw unit 2 which is attached to the rotary body 5 is permitted to rotate about the pivot 13 with an appreciably lower effort. It will of course be readily apparent that the elastic resistance of the assembly to rotational displacement can be adjusted by screwing the hollow nut 31 on the threaded end 33 formed at the front end of the stud 34, the hollow nut 31 being screwed onto the stud 34 to a greater or lesser extent so as to increase or reduce the stiffness of the ski binding according to requirements. It should also be noted that, at the time of rotational displacement of the ski binding under torsional stress, the passage 35 formed in the pivot 13 permits displacement of the stud 34 up to the end of the range of rotational travel which is necessary for complete disengagement of the ski boot.

Figure 11:
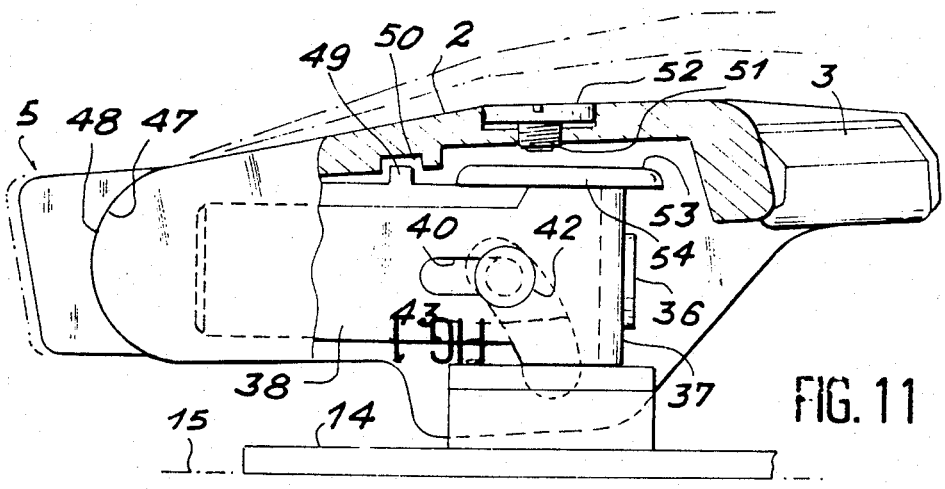
FIG. 11 is a part-sectional view which is similar to FIG. 8 and illustrates the ski binding in a position of ski-boot disengagement corresponding to an incipient backward falling movement of the skier in which the boot-retaining jaw unit undergoes a vertical lifting movement with respect to the plane of the ski.

Similarly, in the event of a backward-fall movement of the skier and a resultant force which is directed upwards in the manner illustrated in FIG. 11, the force being exerted on the boot-retaining jaw unit 2 and in particular on the arms 3 placed on each side of the ski boot 1, the rotary body 2 undergoes a swinging movement in the forward direction. The arcuate slots 43 are applied on the cross-member 41 by means of its sleeves 42, the cross-member 41 being pressed against the pivot 13. By virtue of the profile of the arcuate grooves 43, this produces an effort of forward displacement on the hollow piston 9 and consequently a limited compression of the spring 29. As in the forward-fall condition, this permits withdrawal of the flat face 16 from the abutment member 46 and a limitation in resistance to rotational displacement of the ski binding about its pivot.

It will be noted that, in accordance with the arrangements described in the foregoing, a pivotal displacement of the jaw unit 2 takes place in this case about the axis X-Y by virtue of the cooperation of the circular profiles 47 and the bearing surfaces 48, thus avoiding the need for a material axis which effectively joins the center of rotation of the two parts with respect to each other.

This accordingly has the effect of introducing an appreciable simplification in the manufacture of the multidirectional-trip ski binding considered and, by reducing the number of parts required as well as their complexity, also permits an appreciable reduction in cost of the ski binding.

In the alternative embodiment illustrated in the preceding figures, the boot-retaining jaw unit 2 can be adjusted for height by actuating the adjusting screw 51 which cooperates with the head 54 of the pivot 13 and thus makes it possible to adjust the position-setting of the arms 3 of the jaw unit 2 which surrounds the toe end of the ski boot 1. It will nevertheless be noted that, by subjecting the jaw unit 2 and the rotary body 5 to a movement of relative displacement, the abovementioned adjustment already produces a slight rotation of the circular bearing surfaces 47 on the bearing surfaces 48 in much the same manner as the procedure which takes place at the beginning of a backward fall. The result thereby achieved is that, in this alternative embodiment, the possibilities of height adjustment of the jaw unit by means of the adjusting screw 51 are necessarily limited.

I claim:

1. A safety ski binding comprising a boot-retaining jaw unit for securing either the toe end or the heel end of a ski boot, said boot-retaining jaw unit being mounted on a rotary body for upward pivotal displacement relative to said rotary body, said rotary body being in turn rotatably mounted on a pivot which is perpendicular to the ski and being maintained in a normal position thereof by a resilient mechanism comprising two flat faces which are formed on said pivot in opposite directions and against which a bearing surface formed on said rotary body and a piston housed within said rotary body are applied respectively by a single spring, said boot-retaining jaw unit being maintained in a normal position thereof by a cross-pin whose ends are in contact with guide ramps carried by said boot-retaining jaw unit, wherein:

(a) the first face against which said rotary body is applied is smaller in width than the flat face against which said piston is applied;

(b) said flat face against which said rotary body is applied is oriented in the direction opposite to the ski-boot location;

(c) the pivotal axis of said boot-retaining jaw unit is carried by said piston;

(d) said cross-pin is interposed between said piston and said pivot; and (e) said guide ramps being sized, shaped, and positioned to produce a forward movement of said boot-retaining jaw unit upon upward pivotal displacement of said boot-retaining jaw unit by virtue of the fact that said cross-pin bears on said guide ramps.

2. A ski binding accordng to claim 1, wherein the extremities of said cross-pin associated with said boot-retaining jaw unit are slidably mounted for axial displacement within elongated slots formed in corresponding side walls of said rotary body.

3. A ski binding according to claim 2, wherein the terminal portions of the extremities of said cross-pin associated with said boot-retaining jaw unit are engaged in slot-type openings formed in side cheeks carried by said boot-retaining jaw unit, said guide ramps being formed by the edges of said slot-type openings directed away from the ski-boot location.

4. A ski binding according to claim 1, wherein said boot-retaining jaw unit has two side cheeks, the forwardly-directed portion of each one of said two side cheeks being provided with an end bearing surface of circular shape centered on the pivotal axis of said boot-retaining jaw unit, each one of said end bearing surfaces being capable of rotating on a circular bearing surface which is also centered on the pivotal axis of said boot-retaining jaw unit and formed on the corresponding end portion of said piston.

5. A ski binding according to claim 4, wherein said rotary body is constituted by a U-shaped stirrup-piece which partly surrounds said pivot, said rotary body being rigidly fixed to said piston by means of an axial stud, the body of said axial stud being mounted within said piston, passes through said pivot, and provided with a threaded end portion adapted to cooperate with a nut having a head slidably mounted within said piston for displacement in opposition to said single spring of said resilient mechanism, said single spring being disposed between said head and an abutment member constituting an end-wall of said piston.

6. A ski binding according to claim 5, wherein said axial stud traverses said pivot via a passage having a double-cone profile of oblong shape designed so as to permit angular displacement of said axial stud at the time of a movement of said rotary body about said pivot.

7. A safety ski binding comprising a boot-retaining jaw unit for securing either the toe end or the heel end of a ski boot, said boot-retaining jaw unit being mounted on a rotary body for upward pivotal displacement relative to said rotary body, said rotary body being in turn rotatably mounted on a pivot which is perpendicular to the ski and being maintained in a normal position thereof by a resilient mechanism comprising two flat faces which are formed on said pivot in opposite directions and against which a bearing surface formed on said rotary body and a piston housed within said rotary body are applied respectively by a single spring, said boot-retaining jaw unit being maintained in a normal position thereof by a cross-pin whose ends are in contact with guide ramps carried by said boot-retaining jaw unit, wherein:

(a) the flat face against which said rotary body is applied is smaller in width than the flat face against which said piston is applied;

(b) said flat face against which said rotary body is applied is oriented in the direction opposite to the ski-boot location;

(c) the pivotal axis of said boot-retaining jaw unit is carried by said piston;

(d) said cross-pin is interposed between said piston and said pivot;

(e) said guide ramps are sized, shaped, and positioned to produce a forward movement of said boot-retaining jaw unit upon upward pivotal movement of said boot-retaining jaw unit by virtue of the fact that said cross-pin bears on said guide ramps;

(f) the pivotal axis of said boot-retaining jaw unit comprises two trunnions formed on the sides of said piston at the end of said piston remote from said pivot;

(g) said trunnions are mounted for sliding motion in the axial direction within elongated openings formed in corresponding side walls of said rotary body; and (h) the ends of said trunnions are engaged in side cheeks which are carried by said boot-retaining jaw unit and are placed on each side of said rotary body.

* * * * *